US007413093B2

(12) United States Patent
Richter et al.

(10) Patent No.: US 7,413,093 B2
(45) Date of Patent: Aug. 19, 2008

(54) UPPER CHORD CROSS-SECTION FOR TELESCOPIC PARTS OF A CRANE

(75) Inventors: Frank Richter, Wilhelmshaven (DE); Enno Sieβels, Schortens (DE); Rocco Staatz, Varel (DE); Franz Paschke, Sande (DE)

(73) Assignee: Grove U.S. LLC, Grove, PA (US)

( * ) Notice: Subject to any disclaimer, the term of this patent is extended or adjusted under 35 U.S.C. 154(b) by 0 days.

(21) Appl. No.: 11/481,052

(22) Filed: Jul. 6, 2006

(65) Prior Publication Data

US 2007/0034588 A1 Feb. 15, 2007

(30) Foreign Application Priority Data

Jul. 7, 2005 (EP) ..... 05014792

(51) Int. Cl.
*B66C 23/04* (2006.01)

(52) U.S. Cl. ..... 212/348

(58) Field of Classification Search ..... 212/348–350
See application file for complete search history.

(56) References Cited

U.S. PATENT DOCUMENTS

| | | | | |
|---|---|---|---|---|
| 6,098,824 | A * | 8/2000 | Krebs et al. | 212/347 |
| 6,481,587 | B2 * | 11/2002 | Higgins | 212/298 |
| 6,726,437 | B2 * | 4/2004 | Albright et al. | 414/728 |

FOREIGN PATENT DOCUMENTS

| | | | |
|---|---|---|---|
| EP | 1 281 658 | * | 7/2002 |
| FR | 2 790 538 | * | 3/1999 |
| JP | 2005-112514 | * | 4/2005 |

* cited by examiner

*Primary Examiner*—Thomas J. Brahan
(74) *Attorney, Agent, or Firm*—Birch, Stewart, Kolasch & Birch, LLP

(57) ABSTRACT

An upper cross-sectional part for a telescopic part of a crane comprises a central flat cross-sectional element and, connected to the central flat cross-sectional element on each side thereof, a first outwardly curved cross-sectional element; a second flat cross-sectional element; a second outwardly curved cross-sectional element; and a third flat cross-sectional element.

10 Claims, 3 Drawing Sheets

UPPER CHORD CROSS-SECTION FOR TELESCOPIC PARTS OF A CRANE

FIELD OF THE INVENTION

The invention relates to a novel cross-section for the upper portion of a telescopic part of a crane. In particular, it relates to a novel cross-section for the upper portion of telescopic parts of a vehicle crane.

BACKGROUND OF THE INVENTION

During operation, telescopic crane jibs are exposed to loads which result primarily in tensile stress in the upper part of the jib cross section, i.e. roughly in the upper half of the cross-section of the telescopic part. Horizontal bending and torsion can also occur due to lateral forces (wind) and off-center loads.

The cross-sectional shape of the upper part of earlier jib sections might be characterized as semi-box shaped profiles or cross-sections as described, for example, in DE 196 24 312 A1. Upper cross-sections for jibs which are adapted in shape were then later described, for example in DE 200 04 016 U1 and in EP 1 321 425 A1. The latter upper portion cross-sections comprised a central flat cross-sectional element and other flat and outwardly curved cross-sectional elements.

It is the object of the present invention to provide a cross-sectional configuration for the upper part of a telescopic crane jib which offers an optimised measure of bearing capacity as well as simplicity of manufacture.

In accordance with the invention, a cross-section for the upper part of a telescopic jib for a crane includes a central flat cross-sectional element. On each side of the central flat element there is connected in succession a first outwardly curved cross-sectional element; a second flat cross-sectional element; a second outwardly curved cross-sectional element; and a third flat cross-sectional element.

The costs of shaping telescopic parts form a substantial portion of the overall manufacturing costs for a crane, and manufacturing costs should be kept as low as possible. On the other hand, the cross-section of a jib should be able to absorb the imposed loads as well as possible. Both of these objectives are achieved with the configuration in accordance with the invention. The central flat cross-sectional element extends on both sides of the vertical longitudinal plane of the telescopic part of the crane, and the aforementioned additional cross-sectional elements are each provided on both sides of this plane. Such a cross-sectional design optimises the stability of the jib while providing also for ease in manufacturing. Using the outwardly curved cross-sectional elements and the flat cross-sectional elements in accordance with the invention creates a number of deflections within the upper part of the jib cross section which act as idealised stiffeners to counteract buckling. For luffing jib operations, however, this is also highly advantageous in pre-tensioned and/or braced jib systems, and the necessity for providing separate stiffeners to counteract buckling is minimised or completely eliminated.

In particular, providing cross-sectional elements in the numbers, shape and arrangement in accordance with the invention has the effect of providing deflections in the lateral cross-sectional parts, such that the individual lateral areas prone to buckling are more sharply delineated and the overall buckling field is reinforced unlike, for example, the relatively large and/or long individual buckling areas provided in accordance with DE 200 04 016 U1. The present invention thus increases the resistance to lateral buckling.

The outwardly curved cross-sectional elements in accordance with the invention can be configured using a single tool and in one canting process, resulting in a total of four deflections or curvatures in the upper chord (upper shell) as a whole.

This leads to easier manufacturability and lower costs as compared, for example, to generation of curved elements which are expanded and connected to each other as in EP 1 321 425 A1. The flat (or planar- or linear-running) cross-sectional elements afford the option of positioning the canting tool very precisely and, thus, ensure high process reliability. The present invention, thus, achieves an optimum synthesis of manufacturing optimisation and stability optimisation.

In accordance with one embodiment of the invention, the third flat cross-sectional element noted above runs parallel to the vertical longitudinal plane of the telescopic part of the crane and forms the lowermost or termination of the upper cross section. Due to such an arrangement, the lower end of the upper cross-section runs linearly or vertically downwards and can, therefore, easily transition into and connect to a part of the lower cross section. This also contributes to achieving an optimised ability of the jib section to absorb force at the connecting point.

Preferably, the above-described upper cross-section forms substantially the entire upper half of the telescopic part, i.e. the lower termination of the upper cross sectional part is situated substantially level with the vertical middle of the jib cross-section. This places the connecting point (welding line) substantially in the zone which remains tension-free when a load is affixed, between the tensile stress zone and the compressive stress zone (top/bottom).

Advantageously, at least one and, preferably, all of the transitions between the flat cross-sectional elements and the outwardly curved cross-sectional elements run tangentially. This avoids stress peaks at the transitions.

With respect to their length and curvature, the cross-sectional elements in accordance with the invention can satisfy one or more of the following conditions:

- the first outwardly curved cross-sectional element may be longer than the second outwardly curved cross-sectional element;
- the central flat cross-sectional element may be longer than the second flat cross-sectional element (as discussed herein, the "central" flat cross-sectional element can also be regarded as the "first" flat cross-sectional element);
- the second flat cross-sectional element may be longer than the third flat cross-sectional element;
- the first outwardly curved cross-sectional element may be outwardly curved more sharply than the second outwardly curved cross-sectional element.

Depending on the specifically desired characteristics, the length ratios and curvature ratios of the respective elements can be inverted, or identical lengths and curvatures can be provided for the respective elements. For smaller jib parts, for example, the second flat cross-sectional element might not be longer than the third flat cross-sectional element. The cross-sectional elements can be arranged, proceeding successively away from the central upper element, in precisely the order initially given above. It is also advantageous in accordance with the invention if the cross-sectional elements are arranged such that flat and curved elements alternate.

"Curvature" or "bend" as used herein mean gradual curved or arched transitions, as opposed to kinked cants or angled transitions (with and without welding seams).

DETAILED DESCRIPTION OF A PREFERRED EMBODIMENT

Typically a telescopic jib consists of a base part and a number of telescopic lengths. In accordance with the invention, the base part and/or the telescopic lengths can exhibit the cross-sectional shape in accordance with the invention.

Figure 1:
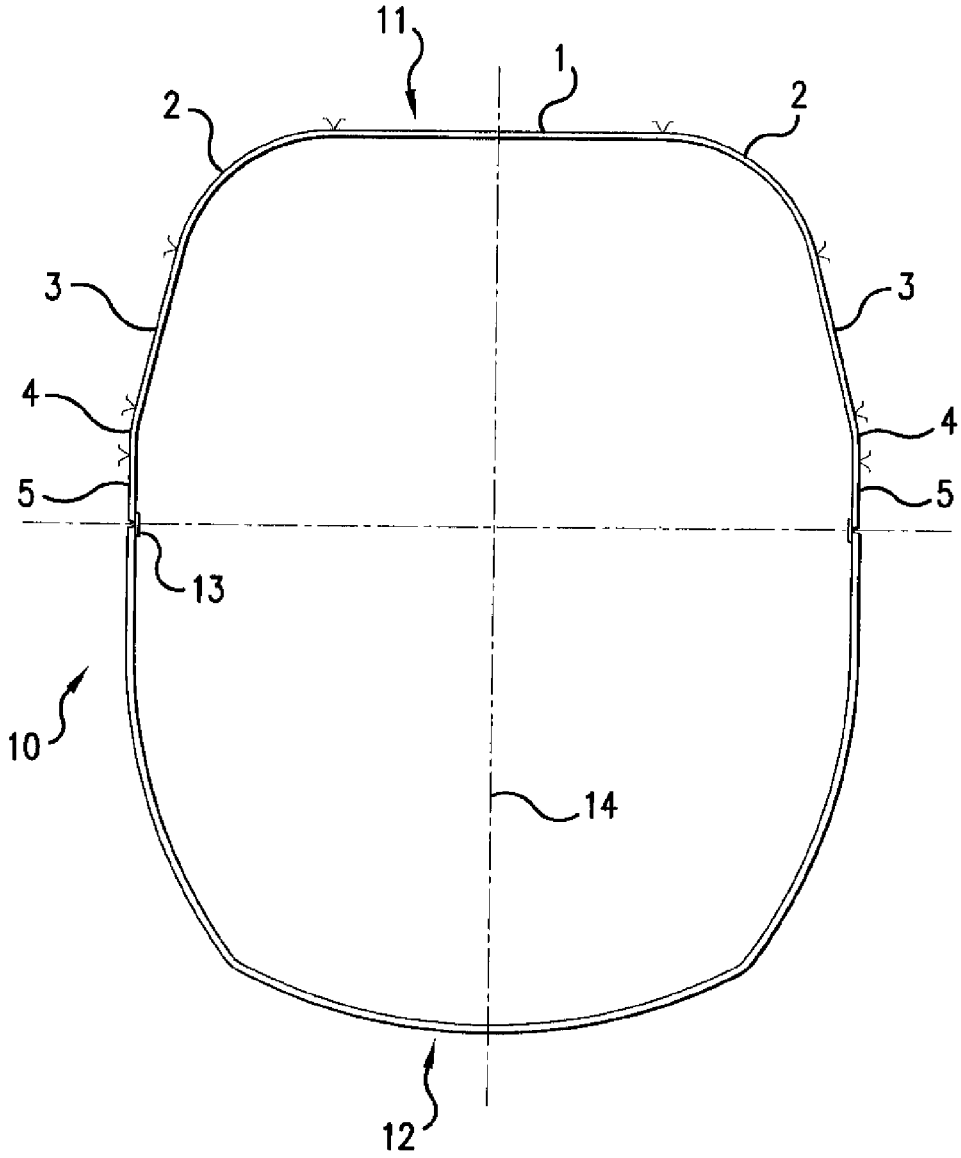
FIG. 1 shows a cross-section for a telescopic jib part of a crane, in particular for a vehicle crane.

In the embodiment of FIG. 1, the cross-section of the telescopic part as a whole is designated by reference numeral 10. Telescopic part 10 comprises an upper part 11 (upper shell) and a lower part 12 (lower shell) which are connected to each other, such as by welding, at the point indicated by reference numeral 13.

In accordance with the embodiment of the invention as shown in FIG. 1, the upper part 11 comprises five flat cross-sectional elements and four outwardly curved cross-sectional elements. Also as illustrated, the flat elements alternate with the outwardly curved elements.

The upper part 11 comprises a flat central element 1 which, in the present embodiment, extends symmetrically to both sides of the vertical longitudinal plane 14 of the section. In the illustrated embodiment, this central portion forms the longest flat cross-sectional element of the upper part.

Directly connected to the cross-sectional element 1 on each side thereof are outwardly curved cross-sectional elements 2, which in turn are followed by the second flat cross-sectional elements 3. The second flat cross-sectional elements 3 are followed by second outwardly curved cross-sectional elements 4, which then each again transition into third flat cross-sectional elements 5. In the illustrated embodiment of the invention, third flat cross-sectional elements 5 also form the lowermost or termination points of the upper cross sectional part. At the lower edge of the flat cross-sectional elements 5, the upper part 11 is connected to the lower part 12 as shown at 13.

The curved cross-sectional elements 2 and 4 are preferably configured such that they can be formed using one tool and in one canting process each. The upper chord 11 then comprises a total of four cantings (curvatures or bends). Due to the linear or flat sections 1, 3 and 5, it is possible to precisely position the canting tool during manufacture, which increases process reliability. Also, since the radii of the curved cross-sectional elements 2 and 4 are preferably configured such that each can be formed using one tool and in one canting process each, changing tools during the manufacturing process becomes superfluous. The radii are selected such that the different material properties, sheet thicknesses and canting angles are taken into account (therefore, other curvature ratios to those given above are also possible, as are inverted ratios). The transitions are tangential where possible, in order to avoid kinks and resulting stress peaks. The first outwardly curved cross-sectional element 2 is curved more sharply than said second outwardly curved cross-sectional element 4. By this it is meant that the curved section 2 subtends a greater angle than the curved section 4 and/or that the radius of curvature of the first curved section is smaller than the radius of curvature of the second curved section.

Figure 2:
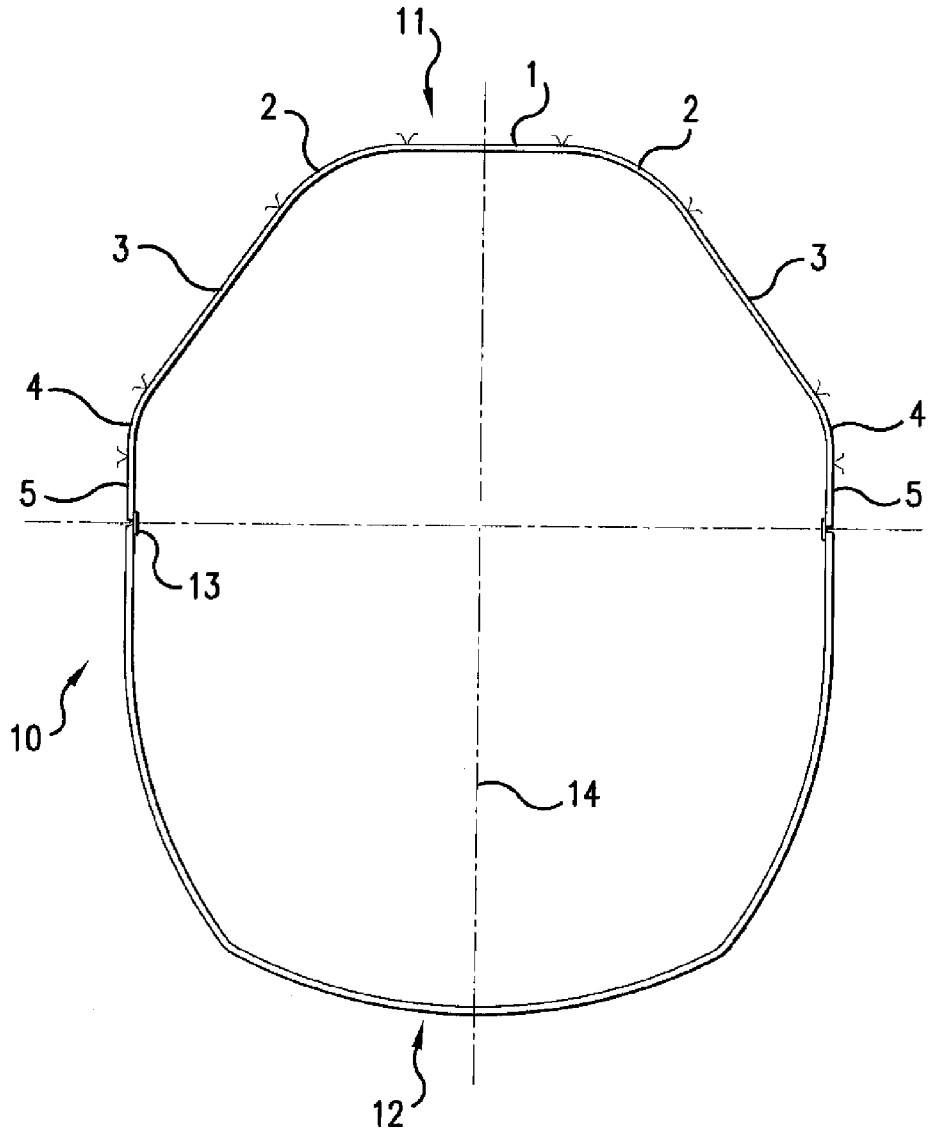
FIGS. 2 and 3 show second and third embodiments of a telescopic jib part of a crane wherein the proportional dimensions of various cross-sectional features are varied from what is illustrated in FIG. 1.
Figure 3:
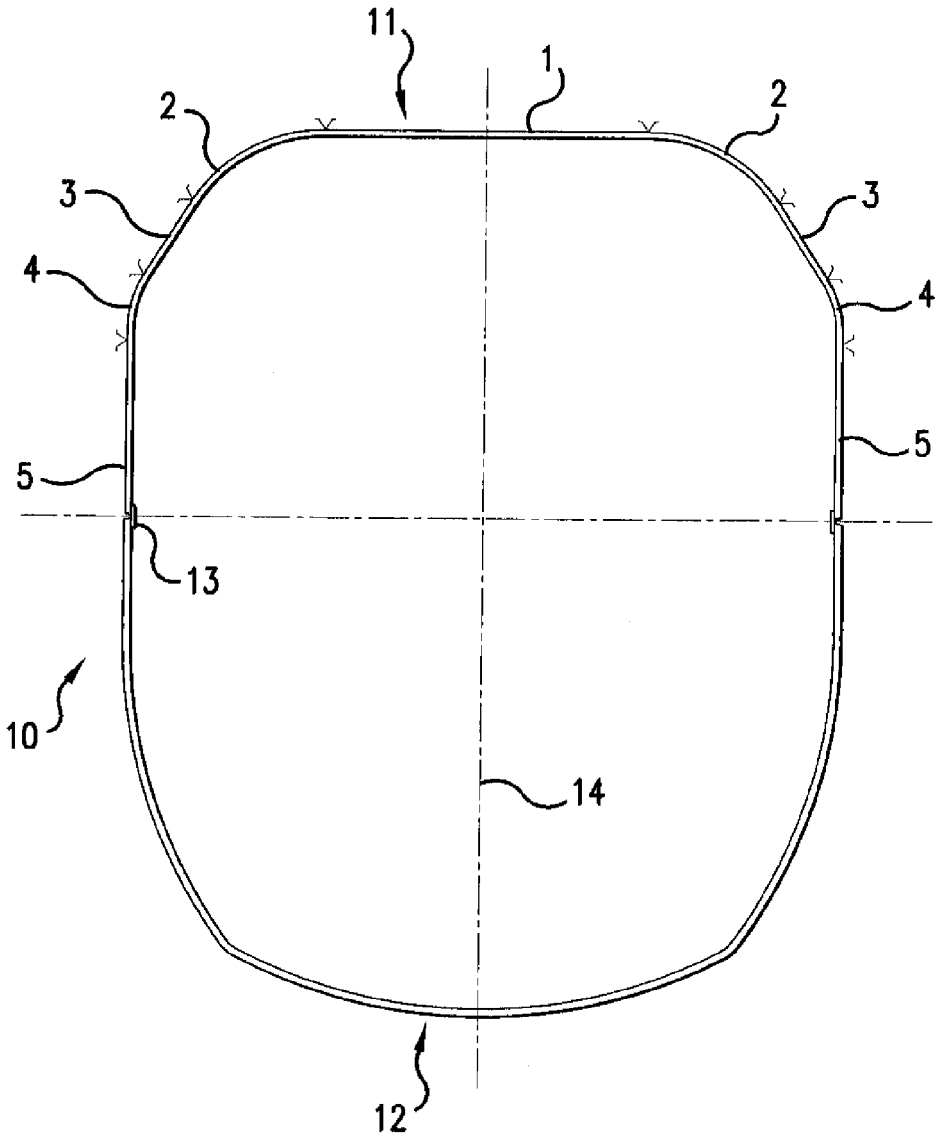

FIG. 2 illustrates an alternative form of the invention in which the length of the central flat portion 1 is equal to or shorter than the length of second flat cross-sectional portion 3. FIG. 3 depicts yet another variation in which the lengths of the second flat cross-sectional portions 3 are equal to or shorter than the lengths of the third flat portions 5.

The curved section deflections in the cross-section act as stiffeners to counteract buckling. The linear sections facilitate manufacturing and therefore overall, the invention provides a cross-sectional shape which is optimised between these parameters.

What is claimed is:

1. A telescopic part for a crane, said part having an upper cross-sectional part and a lower cross-sectional part, said upper cross-sectional part consisting essentially of a central flat cross-sectional segment;

a first outwardly curved cross-sectional segment extending to each side of said central flat cross-sectional segment;

a second flat cross-sectional segment extending from each of said first outwardly curved cross-sectional segments;

a second outwardly curved cross-sectional segment extending from each of said second flat cross-sectional segments; and a third flat cross-sectional segment extending from each of said second outwardly curved cross-sectional segments;

wherein the transitions between the flat cross-sectional segments and the outwardly curved cross-sectional segments run tangentially.

2. The telescopic part according to claim 1, wherein said third flat cross-sectional segments extend parallel to the vertical longitudinal plane of the telescopic section and form lower termination parts of the upper cross-sectional part.

3. The telescopic part according to claim 1, wherein said upper cross-sectional part forms substantially the entire upper half of the cross-section of the telescopic part.

4. The telescopic part according to claim 1, wherein each said first outwardly curved cross-sectional segment is longer than each said second outwardly curved cross-sectional segment.

5. The telescopic part according to claim 1, wherein said central flat cross-sectional segment is longer than each said second flat cross-sectional segment.

6. The telescopic part according to claim 1, wherein each said second flat cross-sectional segment is longer than each said third flat cross-sectional segment.

7. The telescopic part according to claim 1, wherein the length of said central flat cross-sectional segment is equal to or shorter than the length of each said second flat cross-sectional segment.

8. The telescopic part according to claim 1, wherein the length of each said second flat cross-sectional segment is equal to or shorter than the length of each said third flat cross-sectional segment.

9. The telescopic part according to claim 1, wherein each said first outwardly curved cross-sectional segment is curved more sharply than each said second outwardly curved cross-sectional segment.

10. A telescopic part for a crane, said part having an upper cross-sectional part and a lower cross-sectional part, said upper cross-sectional part consisting essentially of a central flat cross-sectional segment;

a first outwardly curved cross-sectional segment extending to each side of said central flat cross-sectional segment;

a second flat cross-sectional segment extending from each of said first outwardly curved cross-sectional segments;

a second outwardly curved cross-sectional segment extending from each of second flat cross-sectional segments; and a third flat cross-sectional segment extending from each of said second outwardly curved cross-sectional segments.

* * * * *